US006519789B1

(12) United States Patent
Hatanaka

(10) Patent No.: US 6,519,789 B1
(45) Date of Patent: Feb. 18, 2003

(54) SHAMPOO BASIN

(75) Inventor: Tetsuji Hatanaka, Osaka (JP)

(73) Assignee: Oohiro Works Co., Ltd., Osaka (JP)

( * ) Notice: Subject to any disclaimer, the term of this patent is extended or adjusted under 35 U.S.C. 154(b) by 0 days.

(21) Appl. No.: 09/974,874

(22) Filed: Oct. 12, 2001

(30) Foreign Application Priority Data

Jul. 27, 2001 (JP) ..... 2001-228052

(51) Int. Cl.[7] ..... A45D 19/08
(52) U.S. Cl. ..... 4/519
(58) Field of Search ..... 4/519

(56) References Cited

U.S. PATENT DOCUMENTS 2,194,804 A * 3/1940 Mayhew ..... 4/519
5,289,597 A * 3/1994 Sidola ..... 4/519

FOREIGN PATENT DOCUMENTS

DE 165451 * 3/1950 ..... 4/519
WO 9504484 * 2/1995 ..... 4/519

* cited by examiner

*Primary Examiner*—Robert M. Fetsuga
(74) *Attorney, Agent, or Firm*—Birch, Stewart, Kolasch & Birch, LLP

(57) ABSTRACT

Provision is made of a shampoo basin which is designed to support the neck of a person to be washed and rinsed without causing pain, with or without a cushion medium, and a combination of the shampoo basin and a chair.

The shampoo basin for washing and rinsing the hair of a person sitting on a chair has a neck-supporting member 4 disposed forwardly of a basin body 2 and composed of an internal corner 41 positioned on the inner peripheral surface side of the basin body 2, an external corner 42 positioned on the outer peripheral surface side of the basin body 2, and a top surface 43 interposed between the internal and external corners 41, 42. The top surface 43 has a curvature radius larger than those of the internal and external corners 41, 42 to support the neck.

7 Claims, 9 Drawing Sheets

BACKGROUND ART

SHAMPOO BASIN

CROSS-REFERENCE TO RELATED APPLICATION

The present application claims priority under 35 U.S.C. §119 to Japanese Patent Application No. 2001-228052, filed Jul. 27, 2001, the entire contents of which are hereby incorporated by reference.

BACKGROUND OF THE INVENTION

1. Field of the Invention

The present invention relates to a shampoo basin for use at barber shops and beauty salons, and to a combination shampoo basin and chair.

2. Description of Background Art

Customarily, professional barbers and stylists wash and rinse their customers hair in shampoo basins. To have their hair washed or rinsed in a conventional shampoo basin, customers must assume one of two postures: either lie on a chair positioned in front of the basin and adjusted almost horizontally, or sit in front of the basin in a chair which reclines toward the basin at an angle greater than 45 degrees.

The present invention is especially related to the second configuration.

Unlike the first configuration, which requires customers to lie down, the second configuration requires customers to lean their heads back over the shampoo basin, which is often equipped with a cushioning medium to support the neck and to minimize discomfort.

Specifically, a basin body may be made of a synthetic resin, such as fiber-reinforced plastic, or a hard material, such as porcelain, and is equipped on an upper edge with a cushioning medium having an inverted U-shape in cross section, to support a customer's neck. The profile of the upper edge is a single curved surface.

However, installing a cushioning medium affects the upper edge of the basin body, reducing its available width.

A prior art basin body arranged to support the neck along the upper edge thereof is shown in FIG. 9. FIG. 9 is a central longitudinal cross sectional view of a shampoo basin body 101 in use.

The shampoo basin illustrated was made as a trial by the inventor of the present invention. This trial basin retains the technical premise of prior art shampoo basins, i.e., a neck-supporting member 102 of the basin body 101 has a relatively narrow upper edge 103. The profile of the edge constitutes a single curved surface.

Accordingly, a neck k of a person contacts the neck-supporting member 102 at a small section of the upper edge 103, frequently causing neck pain.

Applying a cushioning medium to the basin body may serve to prevent neck pain, but such cushions lack durability and are inconvenient when cleaning the shampoo basin.

Thus, the present invention provides a shampoo basin which supports the neck of a person with or without a cushioning medium, and a combination shampoo basin and chair.

SUMMARY AND OBJECTS OF THE INVENTION

The present invention includes a shampoo basin 1 for washing and rinsing the hair of a person sitting on a chair while supporting the person's neck. The shampoo basin comprises an open-top basin body 2 and a neck-supporting member 4, which is a part of the upper edge of the basin body 2 and has an internal corner 41 positioned inside and an external corner 42 positioned outside on a peripheral surface side 44 of said basin body. A top surface 43, located between the internal and external corners 41, 42, has a curvature radius larger than those of the internal and external corners 41, 42 to support a customer's neck.

The top surface 43 can be either a flat surface (an infinite surface in the curvature radius, so to speak) or a curved surface. If curved, preferably, the top surface 43 curves slightly upward, with a curvature radius larger than those of the internal and external corners 41, 42.

Additionally, the present invention provides a combination shampoo basin and chair including the above-described shampoo basin and a chair 5 positioned in front of said shampoo basin and on which is seated a person whose hair is to be washed and/or rinsed. A backrest 52 of the chair 5 reclines.

The top surface 43 inclines slightly at an angle formed by an imaginary line linking the end of the internal corner 41 with the end of the external corner 42, and a horizontal line which preferably inclines at an angle in the range of from 5 to 25 degrees and, more preferably, from 10 to 20 degrees. This enables the neck to rest comfortably on the top surface 43, resulting in minimal neck pain if any.

The top surface 43 can be made sufficiently wide in a longitudinal direction. The width between the end of the inner peripheral side of the internal corner 41 and the end of the outer peripheral surface side of the external corner 42 is preferably around 4 to 8 cm to support a person's neck, resulting in minimal neck pain if any.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

Figure 1:
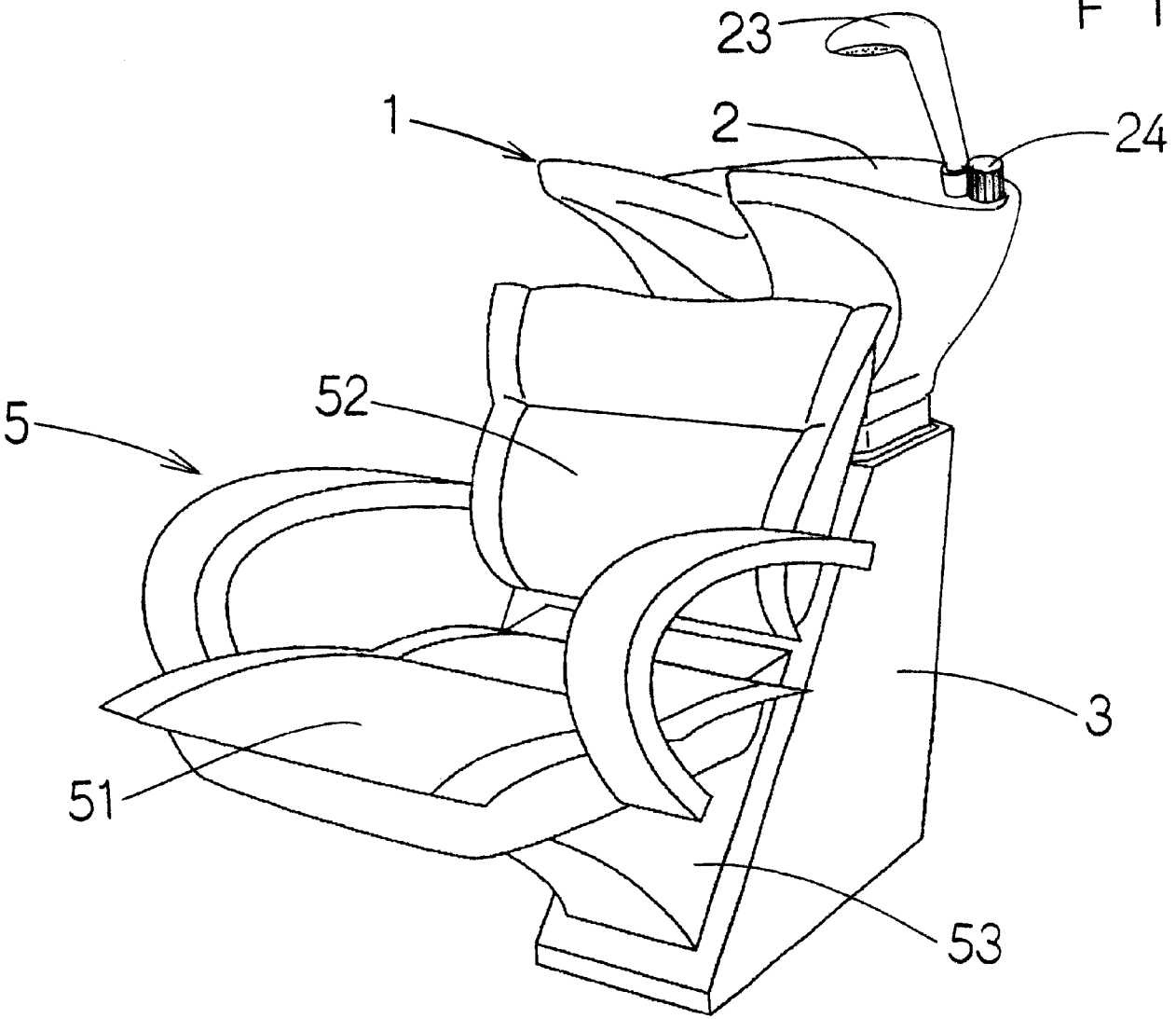
FIG. 1 is a perspective view of a shampoo basin and chair in accordance with the present invention.

In the present invention, a shampoo basin 1 is provided for washing and rinsing the hair of a person sitting on a chair 5. The person's neck is supported on a top surface 43 of said shampoo basin. As shown in FIG. 1, the chair 5 is positioned in front of the shampoo basin 1.

The chair 5 comprises a seat 51 and a backrest 52 located behind said seat 51 for supporting a person's back. A support member 53 provided beneath said seat 51 stabilizes the chair on the floor.

The most desirable posture of a person sitting on the chair whose hair is to be washed and/or rinsed is reclining vertically at an angle of from 70 to 80 degrees, but an angle of from 30 to 45 degrees between the level line and the reclining backrest 52 is also acceptable.

The shampoo basin 1 is provided with an open-top basin body 2 made of porcelain or synthesized resin. A support member 3 stabilizes the basin body 2.

The support member 3 is detachably connected to the support member 53 of a chair 5 at the lower part thereof as shown in FIG. 1. Because the support member 3 is detachable, the shampoo basin and the chair may be used separately. The support members 3 and 53 can appear united in a single casing despite their independent respective structures inside the casing. FIGS. 2 to 8 show the basin body 2 alone.

The basin body 2 has a sink 21 and a neck-supporting member 4 in the top surface 43. The sink 21 can be substantially circular, elliptical, rectangular, etc. In the described embodiment, right and left projections 22, 22 are formed forward from the right and left front portions to prevent the person's upper body from getting wet and to ease the washing of the person's hair.

Figure 2:
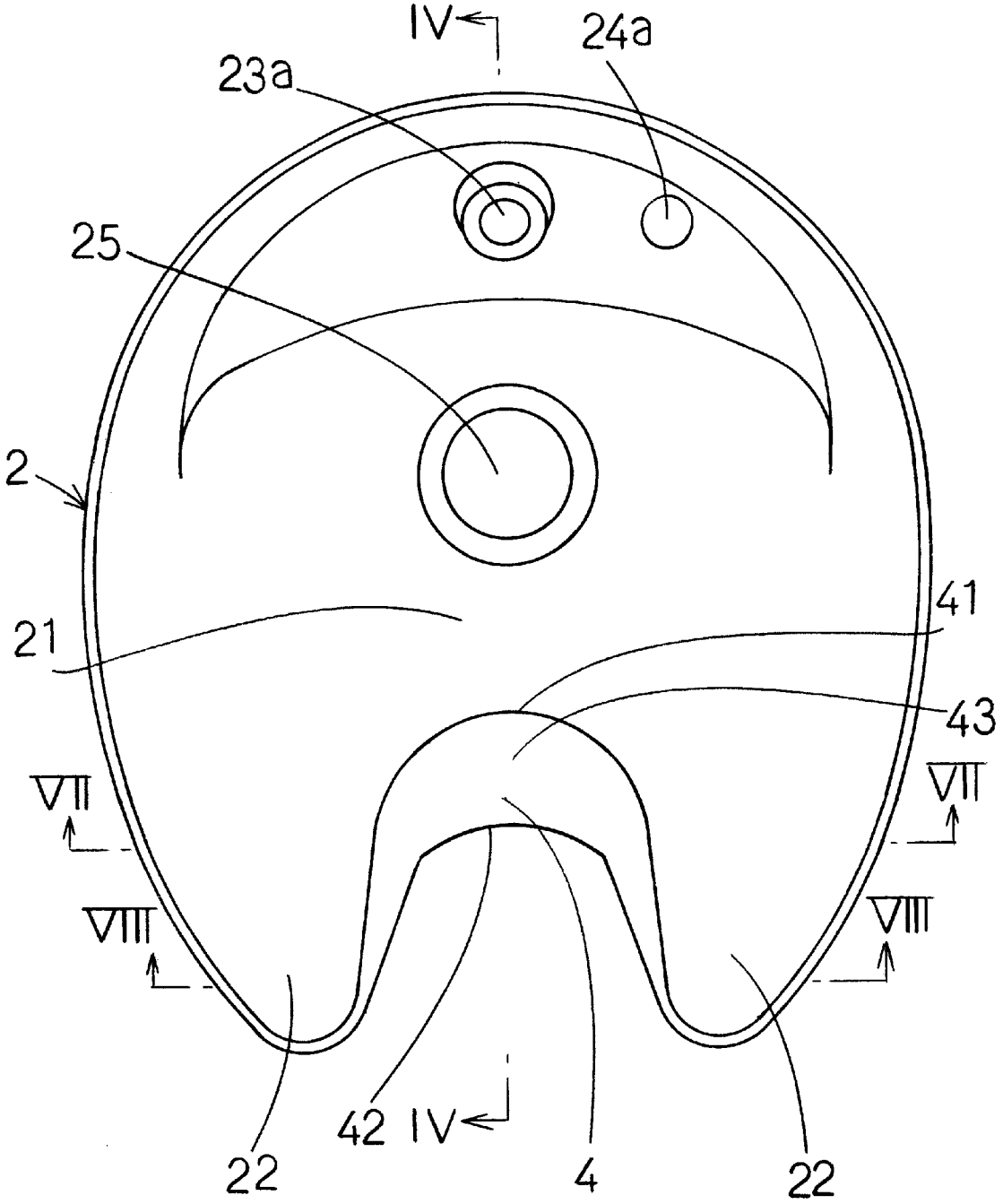
FIG. 2 is a plan view of a shampoo basin in accordance with the present invention.
Figure 3:
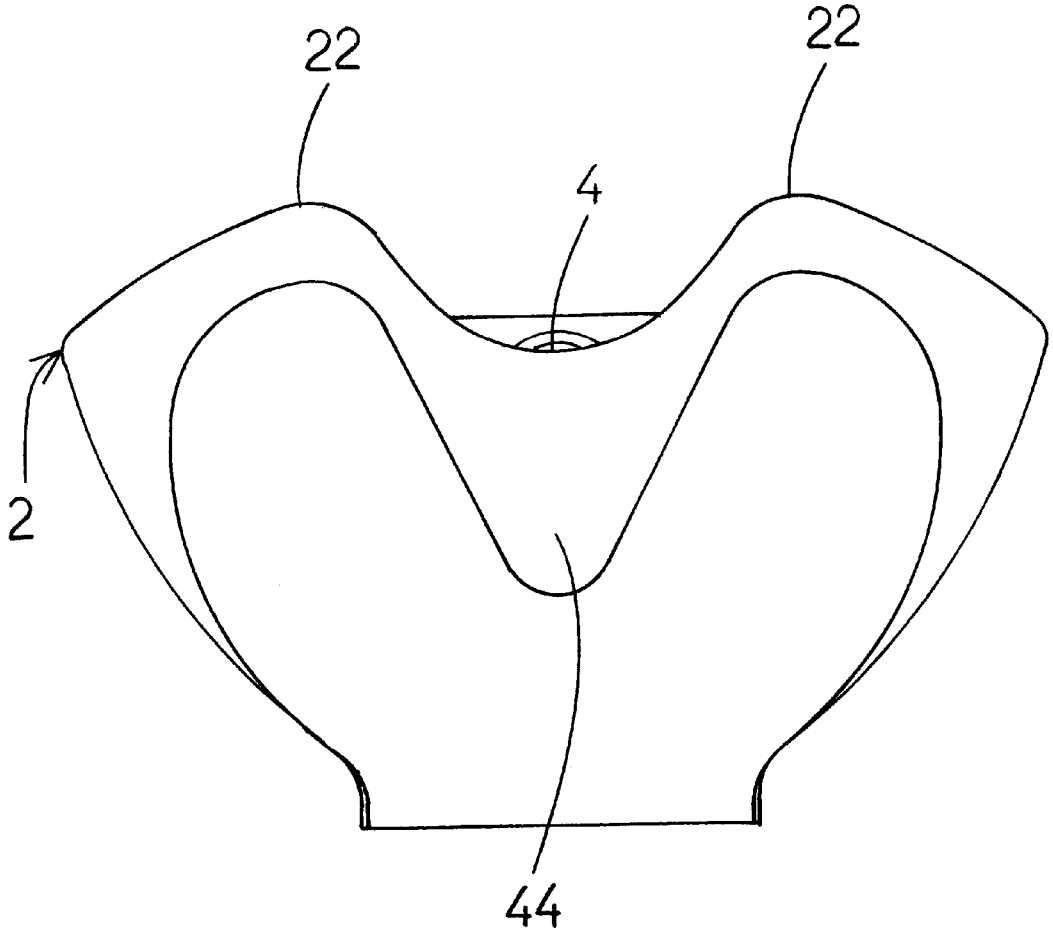
FIG. 3 is a front view of a shampoo basin in accordance with the present invention.

In the embodiment shown, the shampoo basin 1 is equipped with a pull-out spray nozzle 23 and a tap 24 for regulating the flow of water. However, these water appliances need not be built into the basin body 2; they can be put beside the shampoo basin 1. For example, FIG. 2 shows temporary holes for a pull-out spray nozzle 23, a tap 24, and a drain 25.

The pull-out spray nozzle 23 comes out of a shower-receiving hole 23*a*. When the pull-out spray nozzle 23 is out of the shower-receiving hole 23*a*, a hose (not shown in FIG. 2) connected to the pull-out spray nozzle 23 is pulled out through the shower-receiving hole 23*a*, whereby hair can be washed and/or rinsed easily.

The neck-supporting member 4 comprises a part of the upper edge of the basin body 2 and contacts the neck of a person whose hair is to be washed. In the plan view of FIG. 2, the top surface 43 and the neck-supporting member 4 are formed extending backward from the right and left projections 22, 22.

Figure 4:
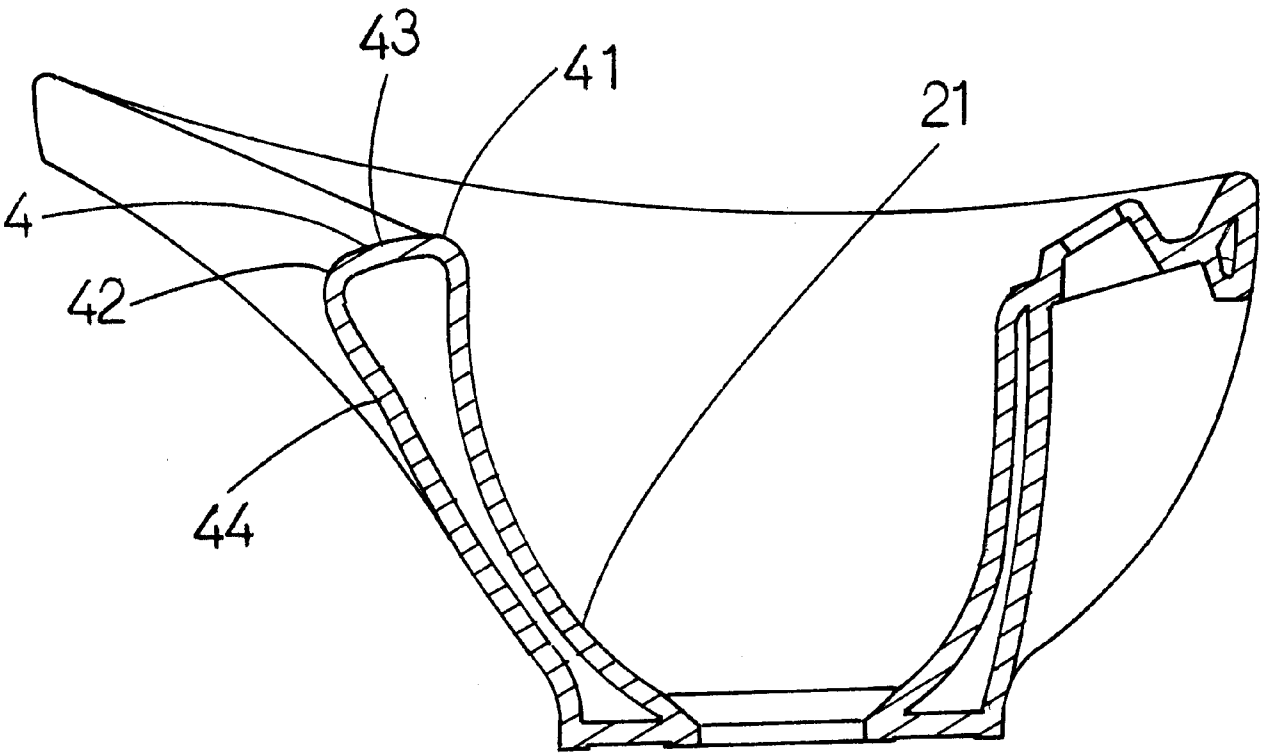
FIG. 4 is a cross sectional view of the shampoo basin taken along line IV—IV of FIG. 2.
Figure 5:
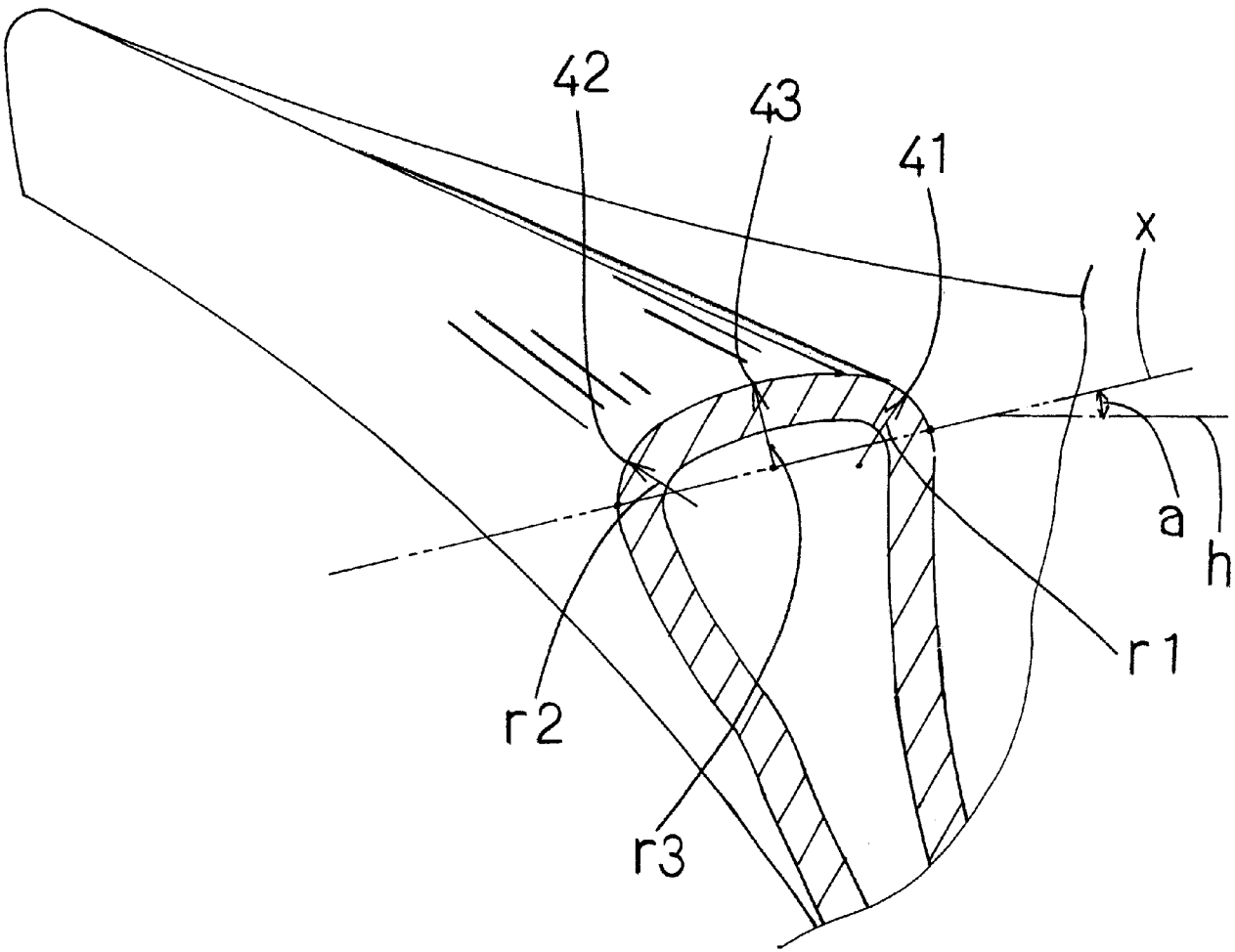
FIG. 5 is an enlarged view of a principal part of FIG. 4.

The neck-supporting member 4 comprises an internal corner 41 positioned in the inner peripheral surface side 21 of the basin body 2, an external corner 42 positioned in the outer peripheral surface side 44 of the basin body 2, and a top surface 43 positioned between the internal and external corners 41, 42 as shown in FIGS. 4 and 5. The internal corner 41 is a part of the inside of the basin constituting the sink 21, and the external corner 42 is a part of the outside of the basin body 2.

Figure 6:
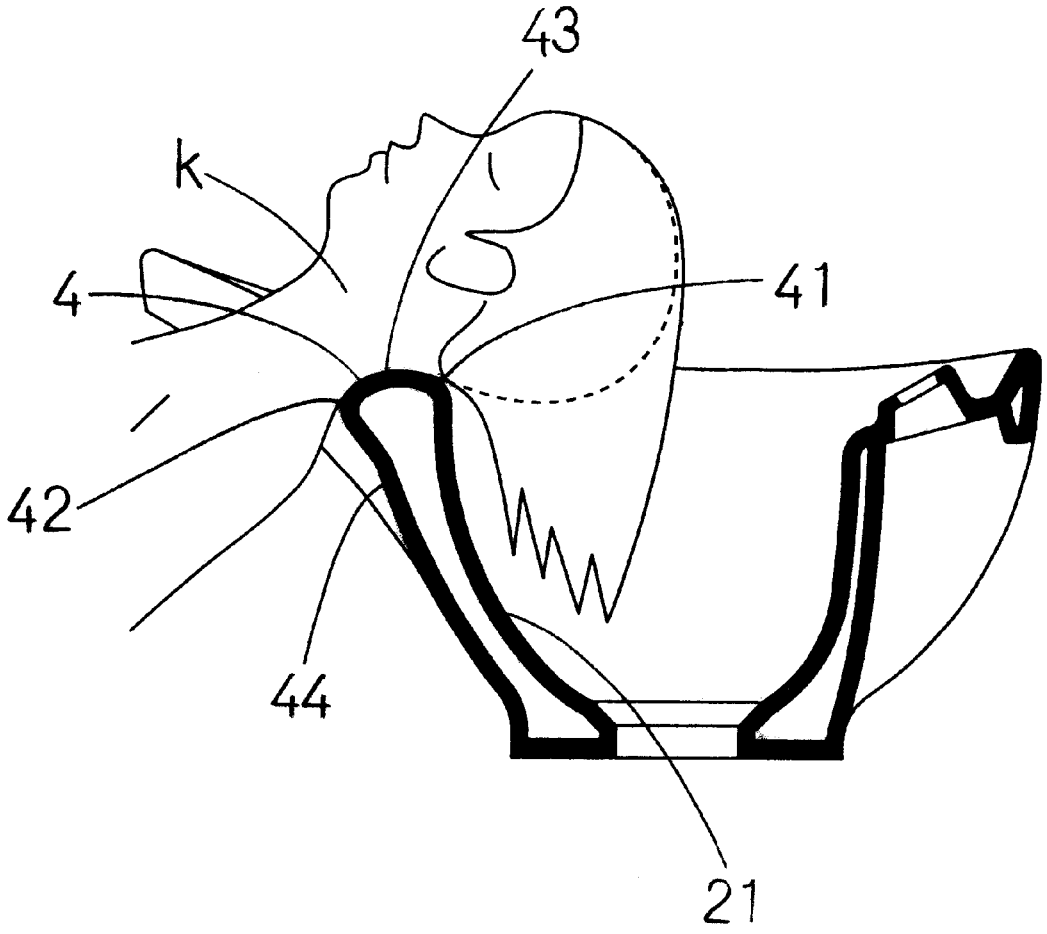
FIG. 6 is a cross sectional view showing a shampoo basin in accordance with the present invention in use.
Figure 7:
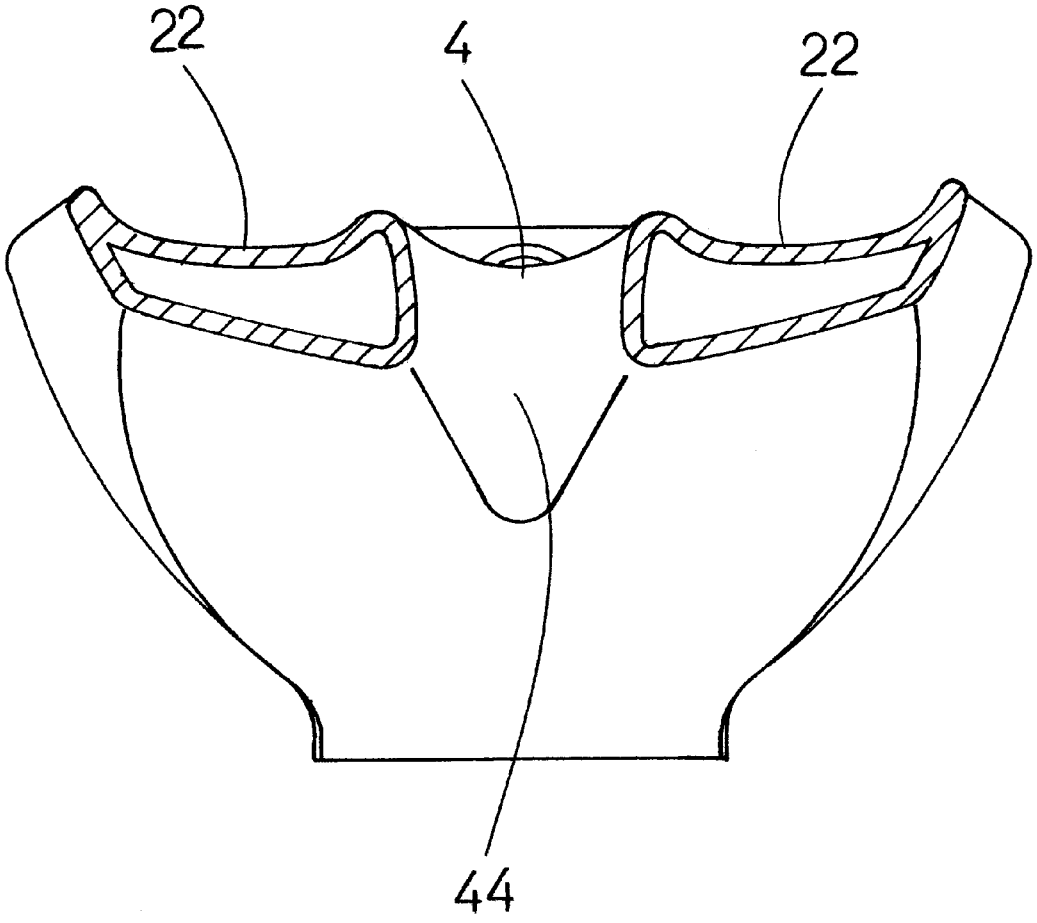
FIG. 7 is a cross sectional view taken along line VII—VII of FIG. 2.
Figure 8:
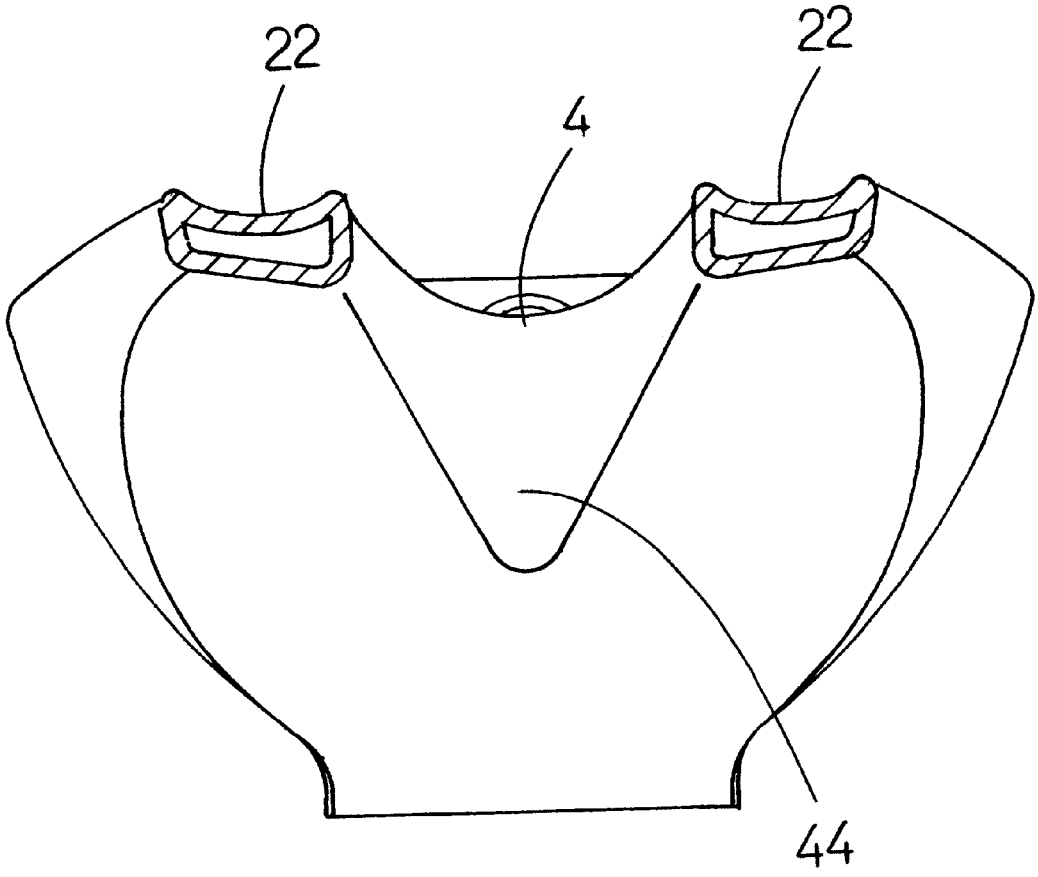
FIG. 8 is a cross sectional view taken along line VIII—VIII of FIG. 2.
Figure 9:
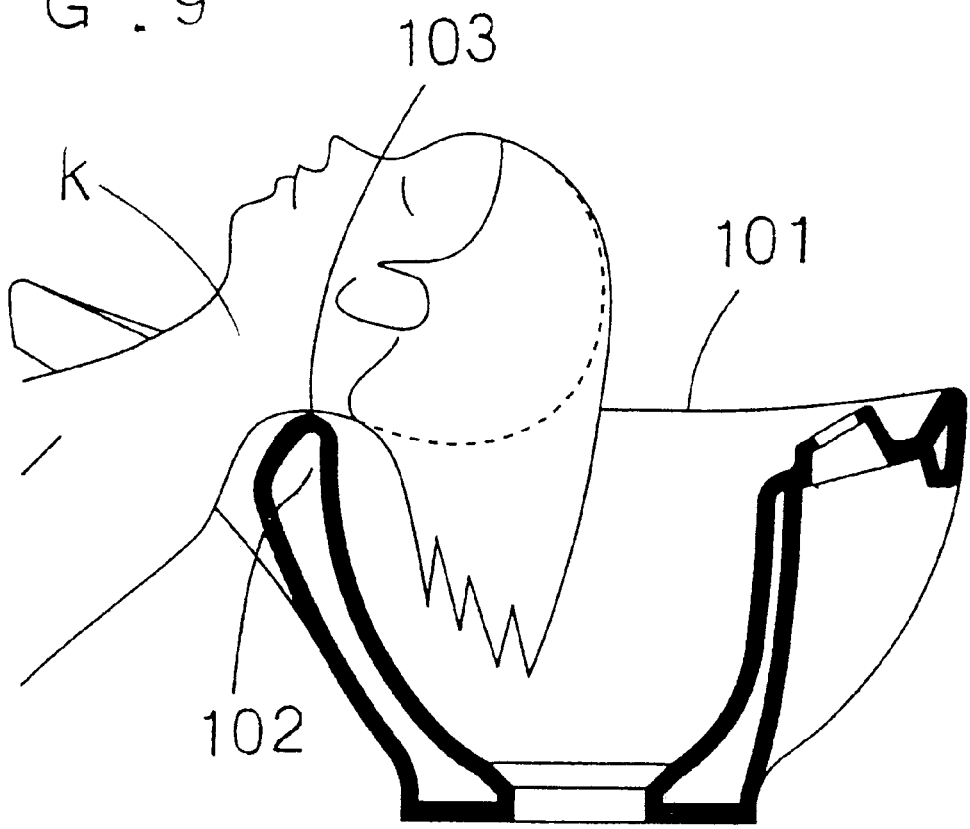
FIG. 9 is a central longitudinal cross sectional view of a conventional shampoo basin produced by the inventor of the present invention.

The top surface 43 has a curvature radius r3 that is larger than the curvature radii r1, r2 of the internal and external corners 41, 42, to form a slightly upward curve. The top surface 43 supports the neck k of a person, as shown in FIG. 6. While supporting the neck k, the top surface 43 remains in contact with said neck on the gently curved surface contoured to the outline of the neck to prevent neck pain.

No hindrance occurs when using a cushioning medium.

Preferably, the number of the curvature radii r1, r2 of the internal and external corners 41, 42 is 1.5 to 3 cm, and the curvature radius r3 of the top surface is 10 to 15 cm. But these numbers can be changed as needed.

Additionally, said corners can be changeable in the form of, for example, an oval that varies in curvature radius.

Preferably, the top surface 43 gently inclines from inner edge to outer edge of the basin. Such an arrangement forms an angle between a hypothetical line x, which links the end of the inner peripheral side (the innermost part when viewed from top) of the internal corner 41 to the end of the external peripheral surface side (the outermost part when viewed from top) of the external corner 42 and a horizontal line h within a range of from 5 to 25 degrees, whereby the neck can be supported without pain.

The size of the angle formed between the basin body 2 and the support member 3 may vary; the ranges provided above are acceptable ranges, but not limitative.

The top surface 43 is sufficiently wide in a longitudinal direction. The width between the end of the inner peripheral side of the internal corner 41 and the end of the outer peripheral surface side of the external corner 42 is within the range of from 4 to 8 cm, so the top surface 43 contacts the neck to provide support. As in the prior art, the upper edge of the basin body 2 other than the neck-supporting member 4 is constituted by the curved surface having a short curvature radius of around 2 cm of its thickness.

When a person sits on a reclining chair in front of the shampoo basin of the present invention, his or her face turns upward, and the person's neck is supported by the neck-supporting member 4 of the basin. The lower part of the neck rests on the external corner 42 first, and when further reclining, the upper part of the neck rests on the internal corner 41 such that eventually the neck has a resting area, not as a point, with the top surface 43 interposed between both corners. As the neck curves with a seat inclined backward, the top surface 43 fits the outline of the neck to support it.

As described, the present invention provides a shampoo basin in which to wash and/or rinse the hair of a person sitting on a chair, wherein the neck is supported on the top part of the edge to prevent neck pain without a cushion medium, and a combination of said shampoo basin and a chair.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shampoo basin for washing and rinsing the hair of a person sitting on a chair and for supporting one's neck, comprising:

an open-top basin body; and a neck-supporting member constituting a part of an upper edge of the basin body and supporting one's neck, said neck-supporting member having an internal corner positioned on an inner peripheral surface side of the basin body, an external corner positioned on an outer peripheral surface side of the basin body, and a top surface, interposed between the internal and external corners, with a curvature radius larger than those of the internal and external corners to support the neck, wherein an angle is formed by an imaginary line linking the end of the inner peripheral side of the internal corner with the end of the outer peripheral surface side of the external corner and a horizontal line, the angle being within a range of from 5 to 25 degrees.

2. The shampoo basin as defined in claim 1, wherein the angle of the imaginary line is within a range of from 10 to 20 degrees.

3. The shampoo basin as defined in claim 2, which has the width, between the end of the inner peripheral side of the internal corner and the end of the outer peripheral surface side of the external corner, being within the range from 4 to 8 cm.

4. The combination of shampoo basin and chair, wherein there are provided the shampoo basin as defined in claim 2 and a chair positioned in front of said shampoo basin, said chair acting to hold a person who is in a seated posture while reclining against the back seat of the chair, and said neck-supporting member of said shampoo basin positioned behind and above the upper end of the back seat.

5. The shampoo basin as defined in claim 1, which has the width, between the end of the inner peripheral side of the internal corner and the end of the outer peripheral surface side of the external corner, being within the range from 4 to 8 cm.

6. The combination of shampoo basin and chair, wherein there are provided the shampoo basin as defined in claim 5 and a chair positioned in front of said shampoo basin, said chair acting to hold a person who is in a seated posture while reclining against the back seat of the chair, and said neck-supporting member of said shampoo basin positioned behind and above the upper end of the back seat.

7. The combination of shampoo basin and chair, wherein there are provided the shampoo basin as defined in claim 1 and a chair positioned in front of said shampoo basin, said chair acting to hold a person who is in a seated posture while reclining against the back seat of the chair, and said neck-supporting member of said shampoo basin positioned behind and above the upper end of the back seat.

* * * * *